FIG. 9 shows a stack of nested containers. The rims 25 of each container can be placed so that they are adjacent each other. The containers 21 can be removed from the stack at will without undue force being required to separate one cup from the other. The rim to rim stacking feature provided by the present invention permits more cups per given stack height, thus reducing shipping space and allowing more cups to be loaded into automatic dispensing machinery. The rim to rim stacking feature is believed to be new in containers such as drinking cups manufactured from foam plastic materials.

The method of subjecting an almost completed container to the sizing action of matched dies is an essential feature of the present invention. The treatment of the container by matched dies 35 and 36 can be considered an ironing process wherein the container sidewall is made uniform in thickness, thus permitting a closer nesting of the cups when they are stacked together.

In the prior art containers, difficulty was encountered in removing single containers from a stacked array containers. The problem was caused by an increase in container wall thickness toward the bottom of the container. The increased thickness is inherent in containers manufactured from oriented foam sheet material, because the material increases in thickness in those areas where the greatest shrinkage occurs.

Although one embodiment of the invention has been set forth in detail, it will be understood that the description thereof is intended to be illustrative, rather than restrictive, as details of the invention may be modified or changed without departing from the spirit of the invention.

What is claimed is:

1. A one-piece container manufactured from plastic foam sheet material, said container having a sidewall terminating at the top with a beaded rim and at the lower end with a closed bottom, said sidewall having at least one overlapped seam running from the rim to the bottom, said sidewall having a uniform thickness from top to bottom yet varying in density from a minimum at the top to a maximum at the bottom, said bottom constructed of two areas, the first area in the form of a concentric ring attached at its outermost extent to the bottom of the sidewall and the second area spanning the central region of the bottom of the cup and attached to said first area, said second area being nearer the top of the container than said first area, said second area containing a centrally positioned bottom closing seam that protrudes downwardly from said second area.

2. A one-piece container manufactured from oriented plastic foam sheet material, said container having a sidewall of frusto-conical configuration terminating at the larger end of the frusto-conical sidewall with beaded rim and having a closed bottom at the smaller end of the frusto-conical sidewall, sidewall having at least one overlapped seam running from the rim to the closed bottom, said sidewall having a uniform thickness that includes the top sidewall area, the bottom sidewall area and the seam area, said bottom having a first planar area and a second planar area, said areas being concentric with respect to each other, said first planar area attached to the sidewall and the second planar area spanning the central region of the bottom of the container, said second area being nearer the top of the container than said first area, said second area containing a downwardly protruding bottom closing seam positioned in the center thereof.

3. A container as claimed in claim 2 wherein the downwardly protruding bottom closing seam is positioned nearer the top of the container than the plane that contains said first planar area, whereby said bottom closing seam does not interfere with the stability of the container when it is set down.

4. A stack of nestable containers as claimed in claim 2 made of foam plastic material, said stack containing a plurality of containers telescoped one over the other, the rims of said containers in contact with each other.

* * * * *

United States Patent [19]

Partain

[11] 4,108,348

[45] Aug. 22, 1978

[54] MULTIPLE PARTITION STRUCTURE FOR PAPERBOARD CONTAINER

[75] Inventor: James H. Partain, Norcross, Ga.

[73] Assignee: Stone Container Corporation, Chicago, Ill.

[21] Appl. No.: 833,027

[22] Filed: Sep. 14, 1977

[51] Int. Cl.[2] ..... B65D 5/48; B65D 25/04

[52] U.S. Cl. ..... 229/15; 229/28 R; 229/27

[58] Field of Search ..... 229/15, 42, 27, 28

[56] References Cited

U.S. PATENT DOCUMENTS

| | | | |
|---|---|---|---|
| 2,830,749 | 4/1958 | Lauritzen | 229/15 |
| 2,899,122 | 8/1959 | Schaeffer | 229/42 X |
| 3,049,279 | 8/1962 | Mairs et al. | 229/27 |
| 3,258,189 | 6/1966 | Graser | 229/15 |
| 3,640,445 | 2/1972 | Durham | 229/15 |
| 3,963,169 | 6/1976 | Gardner | 229/28 R |
| 3,977,592 | 8/1976 | Gorham | 229/28 R |

*Primary Examiner*—Davis T. Moorhead

*Attorney, Agent, or Firm*—Silverman, Cass & Singer, Ltd.

[57] ABSTRACT

An improved integral multiple partition structure for a paperboard container is formed from an integral paperboard blank having a pair of panels connected only along a central connecting portion about which the panels are folded to form the partition structure without separating the panels one from the other. The partition structure may also be made from a portion of an integral paperboard container blank, again allowing the partition to be erected into the completed carton without separating the partition structure from the blank or from either of the partition panels. The partition structure may include a lock for locking the two partition panels into the substantially perpendicular cross-dividing position of the erected partition structure. The panels and the folding connecting portion thereof may be shaped to compensate for the flaps of the container being shorter than the depth of the completed container itself.

23 Claims, 8 Drawing Figures

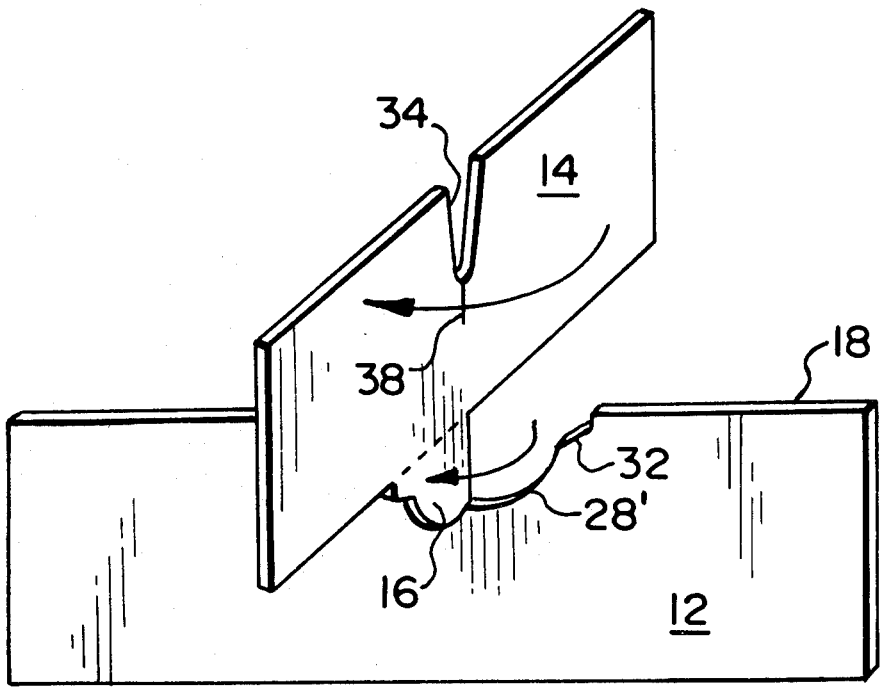

FIG. 1
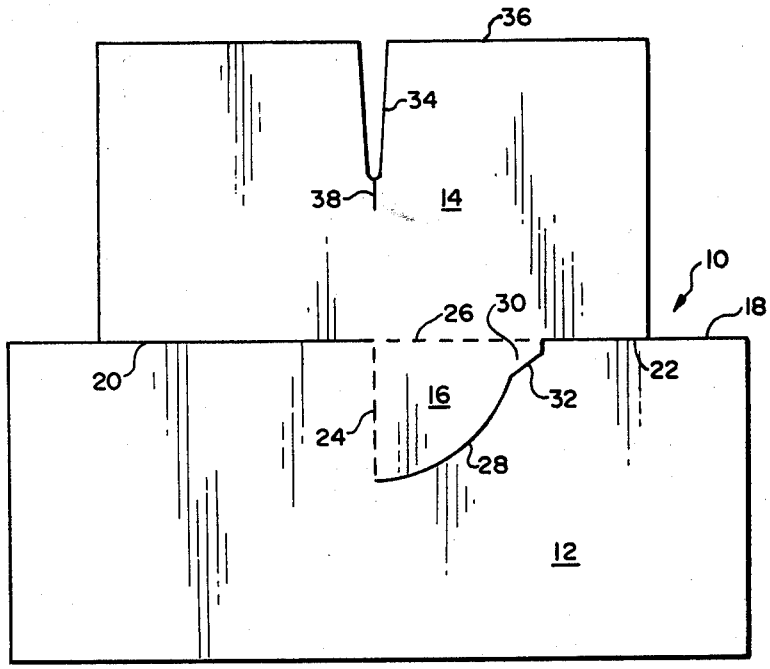
FIG. 2
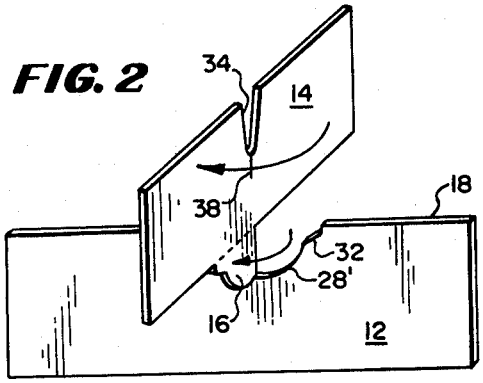
FIG. 3
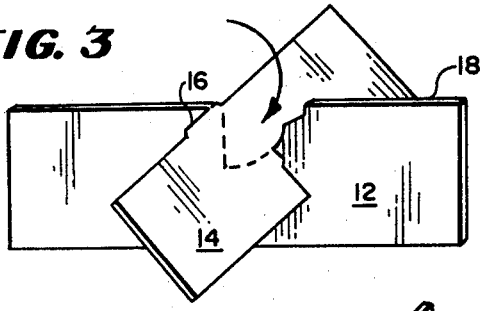
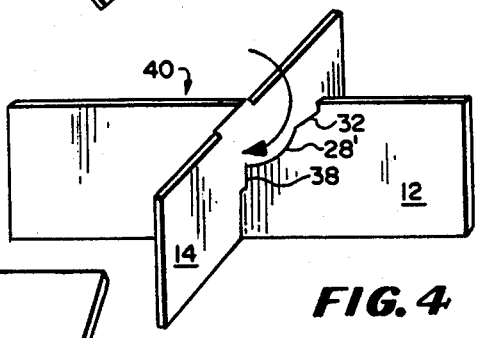
FIG. 4
FIG. 5
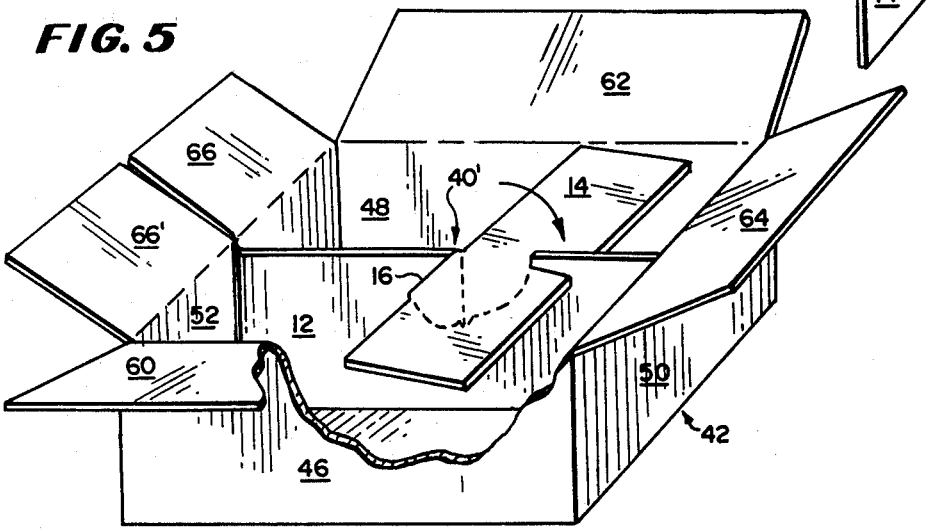

MULTIPLE PARTITION STRUCTURE FOR PAPERBOARD CONTAINER

BACKGROUND OF THE INVENTION

This invention relates generally to a multiple partition structure for a container, and more particularly to a novel multiple partition structure for a conventional paperboard container which is formed from an integral one-piece blank without separating the portions thereof and which may be integral with the container blank itself.

Where receptacles of relatively small size are to be packaged and shipped by manufacturers, it is more practical and economical to package a plurality of individual merchandise receptacles in a single container. To facilitate packaging and to prevent damage to the receptacles during shipment, a partition structure is employed to form separated compartments on the interior of the container for the individual receptacles. This practice is familiar in the shipping of paint products, for instance, or food jars — and many other examples which will readily occur to those skilled in this art. Although there are available partition structures employed in the packaging and shipping of merchandise of this general nature, many disadvantages have been attendant therewith, among which are, lack of suitable simplicity of fabrication and assembly therefor, lack of a highly economical structure and lack of a unitary partition structure which occupies a relatively smaller volume of space until erected for use in the container.

One container partition structure which is formed from an integral partition blank and inserted into a finished container is shown and described in U.S. Pat. No. 2,830,749 issued to Lauritzen on Apr. 15, 1958. This structure solves the problem of having separate panels to form the cross-dividers; however, it involves multiple folds of the partition blank and does not result in a two-panel rigid cross-dividing structure.

One container which attempts to incorporate a partition structure with a minimal number of separate pieces is shown in U.S. Pat. No. 3,977,592 issued to Gorham on Aug. 31, 1976. This container blank includes a partition structure which is formed integral with the main carton blank itself; however, at least one panel must be separated from the partition structure to form the completed partition structure. It would be desirable to form a container with an integral partition structure without separating any of the pieces of the carton blank in the erection of the container itself.

SUMMARY OF THE INVENTION

A multiple partition structure formed from a one-piece, pre-scored foldable blank which includes a pair of panels connected only along a portion of one edge thereof which may be folded into a cross-dividing partition structure without separating one from the other. The connecting portion between the two panels may include a circular edge cut from one panel which mates with a slot formed in the opposite edge of the remaining panel. The end of the circular portion may include a locking notch which mates with the slot or a slit in the end of the slot of the other partition to lock the panels into the partition formation. The size of the two panels and the connecting portion thereof may be sized and adjusted to compensate for varying container flap and side wall dimensions. The partition structure may be formed integral with a one-piece container blank and erected in the partially formed container without separating any of the pieces from the container.

BRIEF DESCRIPTION OF THE DRAWINGS

FIG. 1 is a plan view of a blank from which the multiple partition structure of the invention can be erected;

FIGS. 2 through 4 are an operational sequence of erecting the partition structure from the blank of FIG. 1;

FIG. 5 is a perspective view of a container embodying the multiple partition structure of the invention, partially assembled;

DESCRIPTION OF THE PREFERRED EMBODIMENTS

Figure 6:
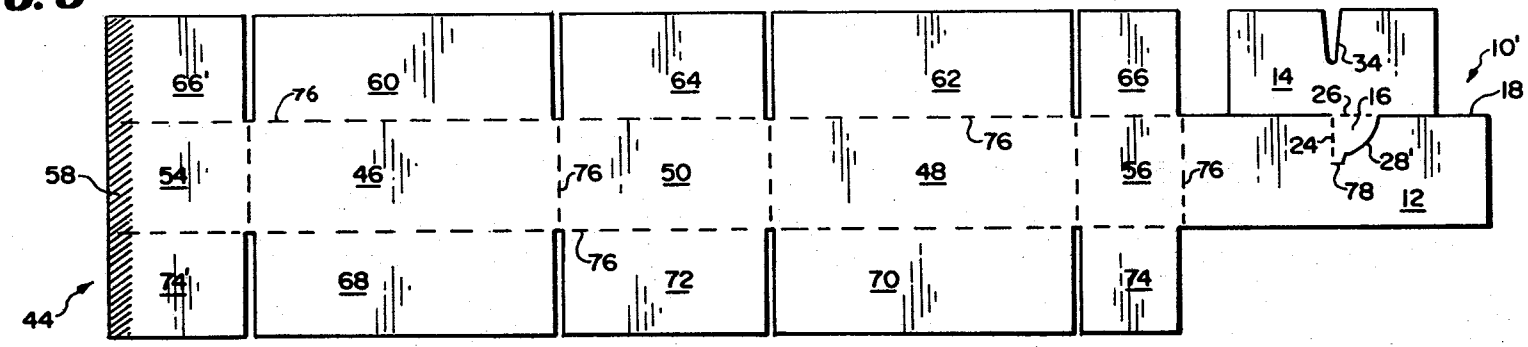
FIG. 6 is a plan view of a carton blank from which the container of FIG. 5 may be erected.

Referring to FIG. 1, there is illustrated a paperboard blank 10 from which the multiple partition structure of the invention may be erected. The partition structure may be erected from the integral blank 10 which may be die-cut from sheeting of paperboard, either corrugated or otherwise, or from other like material by conventional automatic machinery.

The blank 10 includes a first partition panel 12 and a second partition panel 14 joined by a connecting portion 16. A first edge 18 of the first partition panel 12 includes cut lines 20 and 22 separating the first partition panel 12 from the second partition panel 14.

The connecting portion 16 has a first edge 24 hingedly connected along a line of fold to the first partition panel 12 substantially perpendicular to the first edge 18 of the panel. A second edge 26 is hingedly connected to the second partition panel 14 substantially perpendicular to the first edge 24 of the connecting portion 16 and substantially parallel with the first edge 18 of the first partition panel 12.

The connecting portion 16 also includes a third edge 28 connecting the ends of the first and second edges 24, 26 which is separated from the first partition panel 12. The third edge 28 has a generally semi-circular configuration with an offset portion 30 adjacent the end of the second edge 26. The offset portion 30 forms a starting notch 32 adjacent the first edge 18 in the first partition panel 12.

The second partition panel 14 includes a slot 34 bifurcating a free edge 36 of the panel 14 and having an axis aligned substantially parallel with the first edge 24 of the connecting portion 16. The slot 34 may include a slit 28 at its inner end to lock the second partition panel 14 into the erected partition formation with the first partition panel 12 as will be described hereinafter.

The erection of the multiple partition structure from the blank 10 is best illustrated in FIGS. 2 through 4. In erecting the partition structure, the first partition panel 12 is moved substantially perpendicular relative to the second partition panel 14 and the connecting portion 16, as shown in FIG. 2. The second partition panel 14 is then moved relative to both the connecting portion 16 and the first partition panel 12 moving the slot 34 to bifurcate the first partition panel 12 at the starting notch 32.

As the partition panel 14 is moved past the starting notch 32 a mating edge 28' of the panel 12 will engage the slit 38. Once the panel 14 is moved against the connecting portion 16 and the first edge 24 thereof, the engagement of the edge 28' with the slit 38 will firmly lock the second partition panels 12,14 into a completed partition structure 40 as seen in FIGS. 4.

The connecting portion 16, the slot 34 and the slit 38 are sized such that the slot 34 will move relatively freely over the edge 18 of the first partition panel 12; however, the slit 38 will firmly engage the mating cut edge 28' of the partition panel 12 securely locking the two partition panels together. The length and height of the two panels 12 and 14 may of course be adjusted for the height, width and length of a particular container into which the partition structure 40 is desired to be inserted.

Referring now to FIGS. 5 and 6, a container 42 may be formed from a one-piece blank 44. The blank 44 includes an integral partition blank 10' which may be erected into the container 42 with a completed partition structure 40'. In describing the blank 44, the blank 10' and the resulting container 42 erected therefrom, the numerals which identify substantially identical parts to those in FIGS. 1 through 4 will again be utilized. The blank 44 includes a first and a second side wall 46,48 joined together by a first end wall 50.

A second end wall 52 is formed from a first end portion 54 and a second end portion 56 which is overlapped by a free edge 58 of the first end portion 54 and glued or otherwise secured to the second end portion 56 in a conventional manner. The respective walls 46 through 52 include conventional top end flaps 60,62,64 and 66 (shown as 66 and 66' for the two portions thereof). Likewise the four walls include conventional bottom flaps 68,70,72,74 and 74'. Each of the flaps and end walls are joined along conventional lines of folds 76.

The partition blank 10' is hingedly connected at one end of the first partition panel 12 along one of the lines of fold 76 to the second end portion 56 of the wall 52. The blank 44 is then erected in a conventional manner into the carton or container 42, wherein the blank 10' may then be erected into the completed partition structure 40' as previously described.

The blank 10' includes a modified locking structure for the completed partition structure 40'. The locking structure is formed by extending the slot 34 so that it will bear against the edge 28' of the partition panel 12. The edge 28' further includes a locking notch 78 formed adjacent the first edge 24 of the connecting portion 16. The end of the slot 34 will then rest in the locking notch 78 when the partition structure 40' is completely erected in the carton 42.

Figure 7:
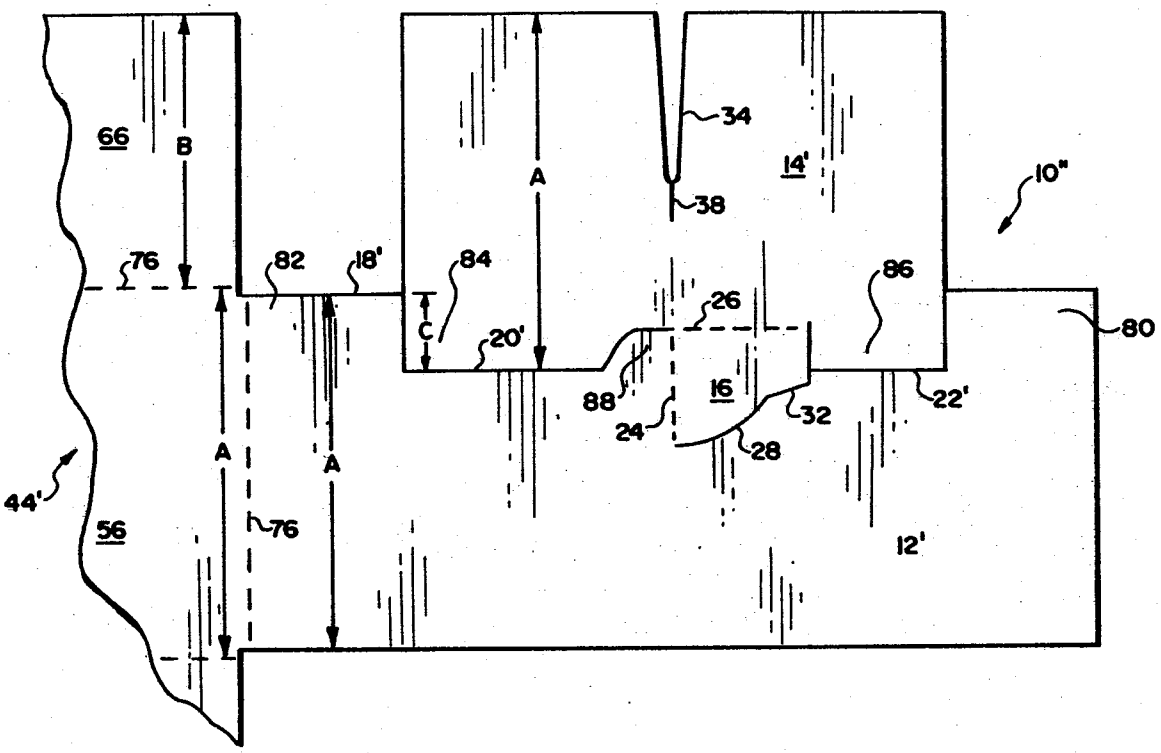
FIG. 7 is a partial plan view of a carton blank including an embodiment of the multiple partition structure of the invention which compensates for the end flaps having a length less than the height of the completed container.

A height compensating embodiment of the partition blank 10'' is illustrated in FIG. 7. The blank 10'' is configured such that the height of the completed partition structure 40'' will be equal along at least a substantial portion thereof to the height "A" of the container wall even though the blank 44', from which the carton 42' and the partition structure 40'' is erected, includes an end flap 66 with a length "B" which is shorter than the length "A". This problem is solved by offsetting the connecting portion 16 and the adjoining edges of the partition panels 12' and 14'.

The first edge 18' of the partition panel 12' is now formed from several line segments. Each end of the partition panel 12' now includes a marginal end portion 80,82 which are of the height "A". The cut lines 20' and 22' are now L-shaped, two segment lines defining a marginal end portion 84 and 86 on each end of the second partition panel 14' to provide the height "A" for these portions of the partition panel 14'. The first partition panel 12' includes an extension 88, along which the first edge 24 of the connecting portion 16 is formed, extending into the marginal end portion 84 of the second partition panel 14' approximately half the distance "C". When the partition panel 14' is folded into the completed partition structure 40'' both of the partition panels 12', 14' will have their end portions with the height "A" equal to and aligned with the height "A" of the walls of the container 44'.

Figure 8:
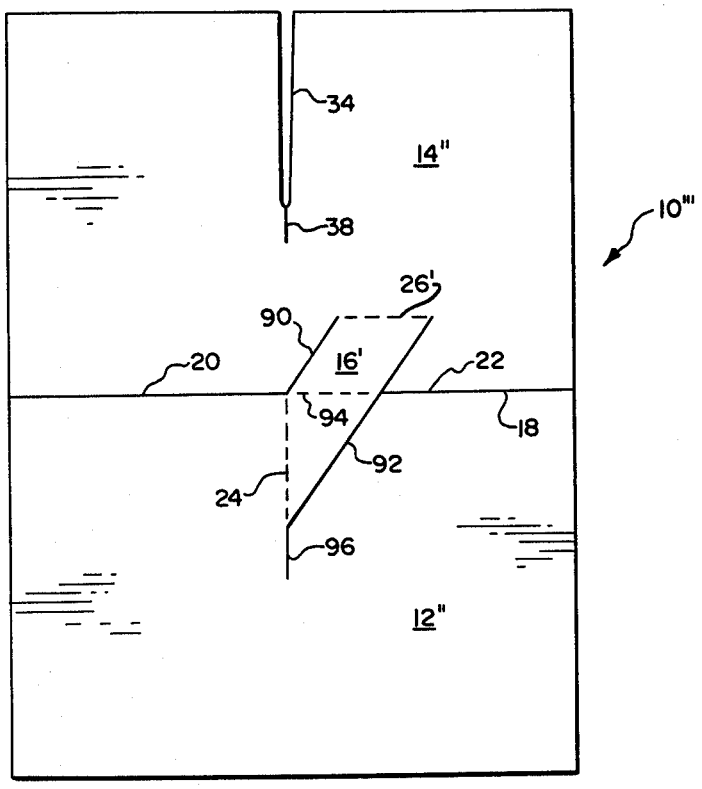
FIG. 8 is a plan view of a blank from which another embodiment of the multiple partition structure can be erected.

Referring now to FIG. 8, another embodiment of the partition blank 10''' is illustrated which includes a modified connecting portion 16'. The first partition panel 12'' is separated from the second partition panel 14'' by cut lines 20 and 22, previously described. The modified connecting portion 16' extends into the partition 14'' and is separated from the partitions 12'' and 14'' by a pair of substantially parallel cut lines 90 and 92. The connecting portion 16' includes a second edge 26' hingedly connected to the partition panel 14'' substantially parallel to the edge 18. In addition, the connecting portion 16' now includes a line of fold 94 which allows the second partition panel 14'' to be folded into the completed partition structure 40'''. In addition to the slit 38 in the second partition panel 14'', a further locking slit 96 is provided beyond the junction of the first edge 24 and the cut line 92 to mate with the slit 38 in the completed partition structure 40''' to further enhance the locking capability of the structure. The partition structure would of course be operable without the additional locking slit 96.

To erect the completed partition structure 40''' from the blank 10''' the partition panel 14'' will first be folded along one of the lines of fold or edges 24 or 26' and then along the remaining one of the two edges. The partition panel 14'' will at that point be spaced from the edge 18 with the connecting portion 16' substantially perpendicular to the plane of the partition 12''. The partition 14'' then will be folded toward the partition 12'' so that the slot 34 will bifurcate the partition 12''. As the partition 14'' is then further folded down the cut line 92 toward the slit 96, the connecting portion 16' will be folded along the line of fold 94 until the completed structure is erected with the connecting portion 16' folded against itself about the line of fold 94 and the two slits 38, 96 mating together to securely lock the completed partition structure 40'''.

It is, of course, to be understood that the invention contemplates implementation thereof in connection with other than the second end portion 56 of the end wall 52. It should further be appreciated that the orientation of the partition structure panels and the container structure with respect to the top or bottom thereof, the labels applied to each panel and the order of describing them is arbitrary. The respective sizes illustrated are also illustrated as an example, and many other combinations of sizes of the walls and panels and the corresponding assembled partition structures and containers are possible within the scope of the invention.

What is desired to be secured by Letters Patent of the United States is:

1. In a container formed from a one-piece blank having at least two side walls, a first end wall having a first width and extending between said two side walls and a